US008764162B2

(12) United States Patent
Chiu

(10) Patent No.: US 8,764,162 B2
(45) Date of Patent: Jul. 1, 2014

(54) CLEANING AND PROTECTING DEVICE AND OFFICE MACHINE USING THE SAME

(71) Applicants: Kinpo Electronics, Inc., New Taipei (TW); Cal-Comp Electronics & Communications Company Limited, New Taipei (TW)

(72) Inventor: Yu-Hsiang Chiu, New Taipei (TW)

(73) Assignees: Kinpo Electronics, Inc., New Taipei (TW); Cal-Comp Electronics & Communications Company Limited, New Taipei (TW)

( * ) Notice: Subject to any disclaimer, the term of this patent is extended or adjusted under 35 U.S.C. 154(b) by 0 days.

(21) Appl. No.: 13/772,359

(22) Filed: Feb. 21, 2013

(65) Prior Publication Data

US 2014/0125733 A1 May 8, 2014

(30) Foreign Application Priority Data

Nov. 8, 2012 (TW) ..... 101141673 A

(51) Int. Cl.
*B41J 2/165* (2006.01)

(52) U.S. Cl.
USPC ..... 347/33; 347/29

(58) Field of Classification Search
USPC ..... 347/22, 29–37, 40, 45–47, 60, 89–90
See application file for complete search history.

(56) References Cited

U.S. PATENT DOCUMENTS

| | | | | |
|---|---|---|---|---|
| 7,614,721 | B2 * | 11/2009 | Ito et al. | 347/33 |
| 7,673,962 | B2 | 3/2010 | Lee | |
| 7,887,157 | B2 * | 2/2011 | Shimazaki | 347/29 |
| 2011/0310171 | A1 | 12/2011 | Supron et al. | |

FOREIGN PATENT DOCUMENTS

| | | |
|---|---|---|
| JP | 7009674 | 1/1995 |

* cited by examiner

*Primary Examiner* — Thinh Nguyen
(74) *Attorney, Agent, or Firm* — Jianq Chyun IP Office

(57) ABSTRACT

A cleaning and protecting device suited for a cartridge is provided. The cartridge moves back and forth along a first axis and has a print head. The cleaning and protecting device includes a cap, a scraper, and a transmission assembly. The cap moves back and forth along a second axis. When the cartridge moves to a first position and the cap moves to a second position, the cap leans against the cartridge to cover the print head. The transmission assembly is coupled to the cap and the scraper. When the cartridge is located at the first position and the cap moves away from the second position, the cap drives the transmission assembly to move the scraper to a third position to scrape the residual ink on the print head. An office machine is also provided.

15 Claims, 11 Drawing Sheets

CLEANING AND PROTECTING DEVICE AND OFFICE MACHINE USING THE SAME

CROSS-REFERENCE TO RELATED APPLICATION

This application claims the priority benefit of Taiwan application serial no. 101141673, filed on Nov. 8, 2012. The entirety of the above-mentioned patent application is hereby incorporated by reference herein and made a part of this specification.

BACKGROUND

1. Field of the Invention

The invention relates to a cleaning and protecting device, and more particularly, to a cleaning and protecting device of a cartridge and an office machine applying the same.

2. Description of Related Art

Following the continuous advances of printing technology, a printing output device, in addition to being available for an output of common texts, is also applicable in outputs of propaganda information and digital photos, so as to fulfill consumer's demands in image output. Wherein, an inkjet printer due to having a low cost, a low operational noise, an excellent print quality, and an advantage of able to be printed on a variety of inkjet media, such as a common paper, a special inkjet printing paper, a photo paper, and a dedicated slide, has been widely used by household, personal studio and even various trades.

However, in the process of printing, an excess ink or dust particles would more or less remain near a print head of a cartridge, thereby inevitably causing an environmental pollution to the printing system. Therefore, most printing systems are configured with two parts, a printing area and a maintenance area, wherein the maintenance area is usually located at a side of the printing system, and an ink scraper is often used to scrape a dirty surface of the print head, so as to avoid the residual ink in the print head from being dried up and causing an obstruction, and to prevent problems of print head blockage, unsmooth ink output and reduced print quality.

In conventional technologies, after the cartridge is moved to one of the sides, a scraping device is mostly removed from the inside and moves towards the print head on the cartridge so as to achieve an effect of scraping the residual ink. Provided that, the scraping device has to be driven with two to three directions before being positioned, and if one of the direction positioning errors occurs, then a final position of the scraping device is most likely to be different from the one that is originally expected, and thereby, a credibility and a reliability of the scraping device are lowered.

SUMMARY OF THE INVENTION

The invention provides a cleaning and protecting device adopting separate driving paths to respectively achieve effects of cleaning a print head and protecting the print head.

The invention provides an office machine, a cleaning and protecting device of a print head thereof has favorable credibility and reliability.

An embodiment of the invention provides a cleaning and protecting device suited for a cartridge. The cartridge is suited for moving back and forth along a first axis and has a print head. The cleaning and protecting device includes a cap, a scraper and a transmission assembly. The cap moves back and forth along the second axis. When the cartridge moves to a first position and the cap moves to a second position, the cap leans against the cartridge to cover the print head. The transmission assembly is coupled to the cap and the scraper. When the cartridge is located at the first position and the cap moves away from the second position, the cap drives the transmission assembly to move the scraper to a third position to scrape the residual ink on the print head.

An embodiment of the invention provides an office machine including a cartridge, a cap, a scraper and a transmission assembly. The cartridge moves back and forth along a first axis and has a print head. The cap moves back and forth along a second axis. When the cartridge moves to a first position and the cap moves to a second position, the cap leans against the cartridge to cover the print head. The transmission assembly is coupled to the cap and the scraper. When the cartridge is located at the first position and the cap moves away from the second position, the cap drives the transmission assembly to move the scraper to a third position to scrape the residual ink on the print head.

In an embodiment of the invention, the first axis is perpendicular to the second axis.

In an embodiment of the invention, the cap has a rack back facing the scraper. The cleaning and protecting device further includes a motor, a gear and a control unit. The gear is connected between the motor and the rack. The control unit is electrically connected to the motor and the cartridge. When the cartridge moves to the first position, the control unit drives the motor to enable the motor to drive the cap to move via the gear and the rack.

In an embodiment of the invention, the scraper has a pair of slide rods. The transmission assembly includes a pedestal, a first connecting rod and a second connecting rod. The pedestal has a pair of rails parallel to a geometrical plane. The first axis is perpendicular to the geometrical plane, and the second axis is located on the geometrical plane. The pair of slide rods is respectively coupled to the pair of rails to move the scraper along the pair of rails. A first end of the first connecting rod is pivotally connected to the pedestal, and a second end of the first connecting rod is pivotally connected to the scraper. A third end of the second connecting rod is pivotally connected to the cap, and a fourth end of the second connecting rod is pivotally connected to the scraper, wherein the pair of slide rods is located between the second end and the fourth end.

In an embodiment of the invention, the cleaning and protecting device further includes a motor and a control unit. The motor is connected to the first end of the first connecting rod to drive the first connecting rod. The control unit is electrically connected to the motor and the cartridge. When the cartridge moves to the first position, the control unit drives the motor to enable the motor to drive the first connecting rod and move the scraper, the second connecting rod and the cap.

In an embodiment of the invention, the cartridge moves on a first path along the first axis. The cap moves on a second path along the second axis. The scraper driven by the transmission assembly is moving on a third path. The first path, the second path and the third path form an intersection.

In an embodiment of the invention, when the cartridge is located at the first position, the cap is located beneath the print head.

In an embodiment of the invention, when the scraper is located at the third position, the scraper is located beneath the print head, and the cap is located beneath the scraper.

In an embodiment of the invention, the office machine further includes a body having two opposite sides. The cartridge moves back and forth along the first axis between the two opposite sides of the body. The cap, the scraper and the transmission assembly are located at one of the two opposite sides of the body.

According to the foregoing, in the embodiments of the invention, the cleaning and protecting device and the office machine applying the same, via the transmission assembly disposed between the cap and the scraper, enable the cap and the scraper to respectively perform maintenance actions (scraping the residual ink and providing the cover) to the cartridge that reaches the destined position through different paths. This allows the components of different actions to be driven with separate paths, and thus, can improve a controllability of the components, namely, can effectively avoid situations caused by misalignment due to a drive error, so that the cleaning and protecting device and the office machine applying the same have the favorable credibility and reliability.

In order to make the aforementioned and other features and advantages of the present invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
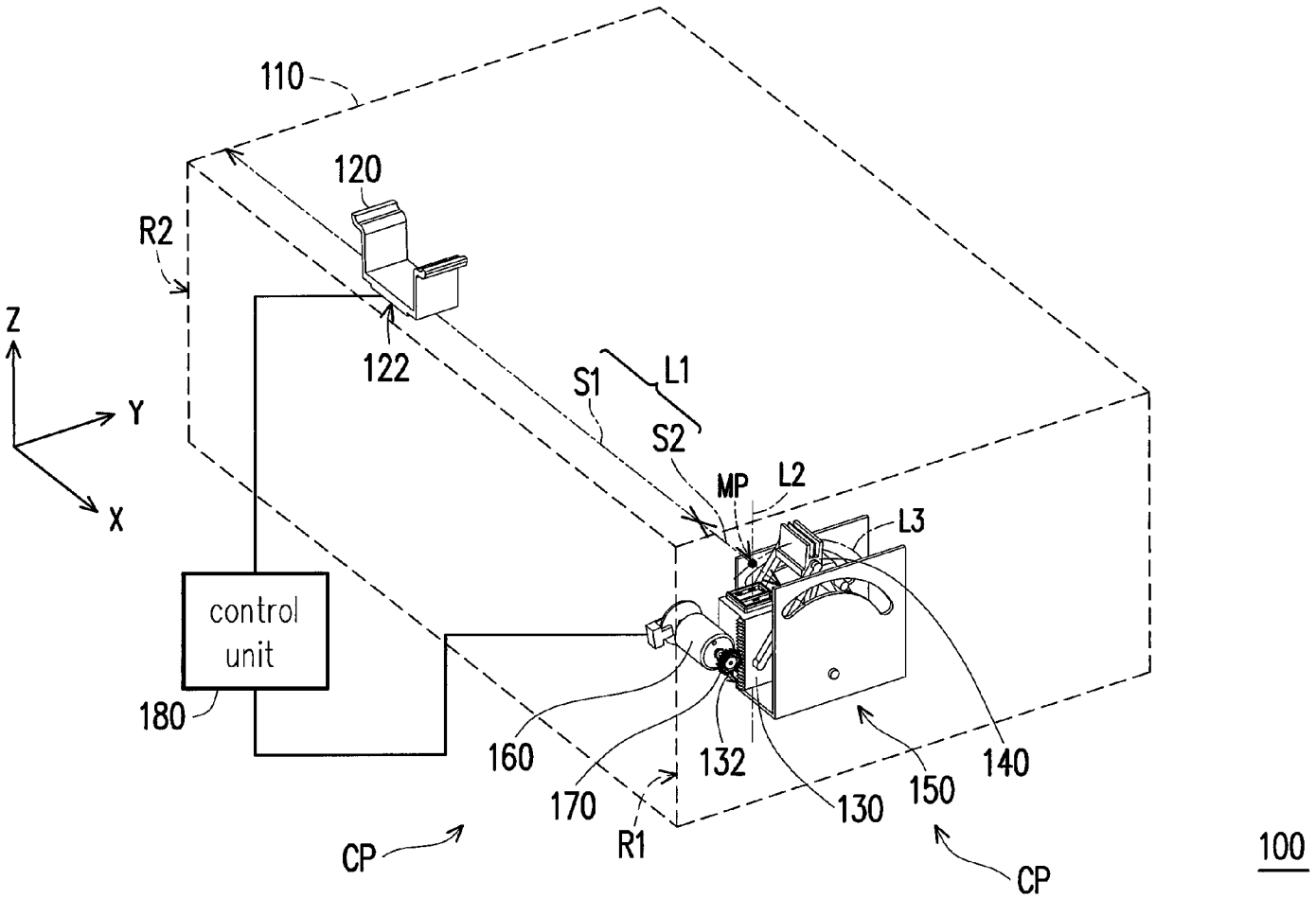
FIG. 1 is a schematic diagram illustrating an office machine according to an embodiment of the invention.
Figure 2:
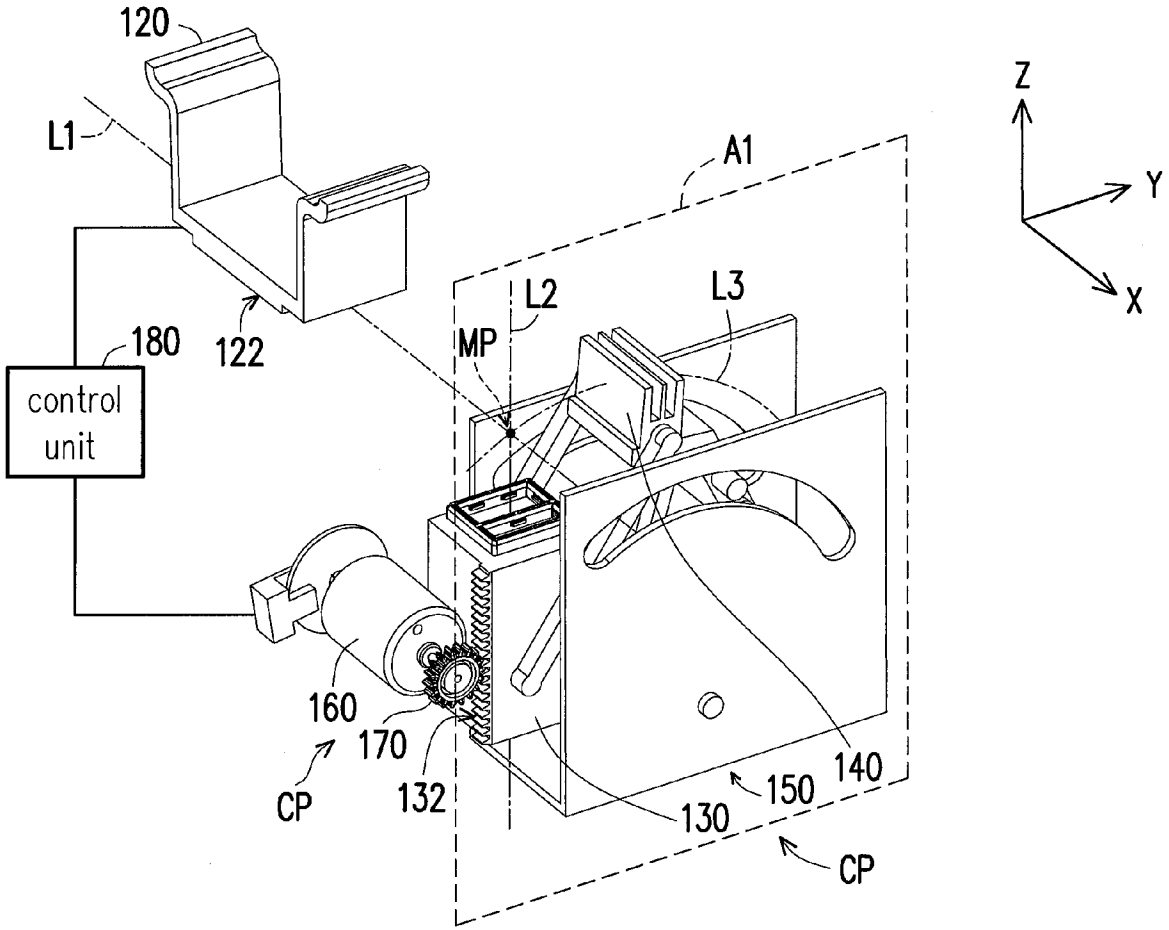
FIG. 2 is a partially enlarged diagram illustrating the office machine of FIG. 1.
Figure 3:
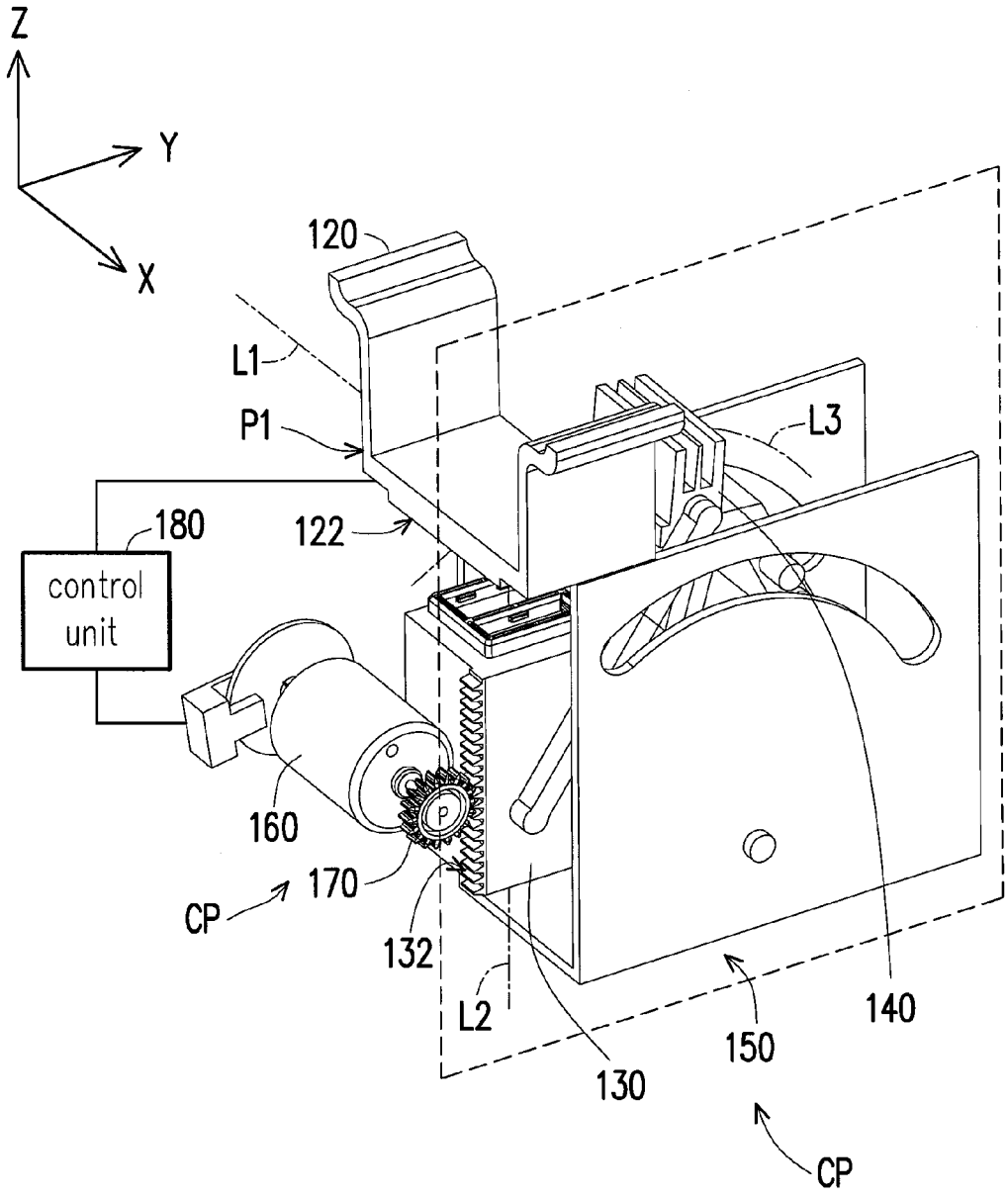
FIG. 3 is a partial enlarged diagram illustrating another type of the office machine in FIG. 1.

FIG. 1 is a schematic diagram illustrating an office machine according to an embodiment of the invention. FIG. 2 is a partially enlarged diagram illustrating the office machine of FIG. 1. FIG. 3 is a partial enlarged diagram illustrating another type of the office machine in FIG. 1. Referring to FIG. 1 through FIG. 3, it is to be explained that the embodiment does not limit the type of the office machine, which is represented merely with a dashed outline in FIG. 1, and therefore, any relative equipment having a cartridge as a printing function thereof may be suited for the present embodiment. Moreover, in order to clearly describe a relative relationship between each component, the present embodiment defines a Cartesian coordinate for a purpose of reference at the same time.

In the present embodiment, an office machine 100 includes a body 110, a cartridge 120 (herein, only a portion is illustrated), a cap 130, a scraper 140 and a transmission assembly 150. The body 110 has two opposite sides R1, R2, and the cartridge 120 moves back and forth along an X axis between the two opposite sides R1, R2 of the body 110, thereby forming a first path L1. Herein, except the body 110 illustrated with the dashed outline, some components not being mentioned (e.g., relative components used for driving the cartridge 120 to move) are already attained by conventional technologies, and thus, are not to be repeated.

The cartridge 120 has a print head 122, and when the print head 122 moves back and forth in a first segment S1 of a first path L1, the cartridge 120 is suited to perform a printing action to a media (e.g., a paper, not illustrated herein) via the print head 122. When the cartridge 120 moves to one of the sides R1 (viz., when the cartridge 120 moves into a second segment S2 of the first path L1), the cartridge 120 stops the printing action and is being in a maintenance state to enable the cap 130 and the scraper 140 to perform a maintenance action to the print head 122. In the present embodiment, the cap 130, the scraper 140 and the transmission assembly 150 are disposed at the side R1 of the body 110 (viz., at the second segment S2 of the first path L1), so as to perform the maintenance action to the print head 122 that enters this segment. Certainly, in another embodiment (not shown), the cap 130, the scraper 140 and the transmission assembly 150 can also be disposed at the another side R2 of the body 110 to perform the maintenance action to the cartridge 120; it is all depending on a component design of the office machine and a use demand and is not limited thereto.

Furthermore, the cap 130, the scraper 140 and the transmission assembly 150 form the main components of the cleaning and protecting device CP of the cartridge 120. The cleaning and protecting device timely scrapes the residual ink and a dirty surface of the print head 122 via the scraper 140 and covers the print head 122 with the cap 130 when the print head 122 is not being used to perform the printing, so as to avoid the residual ink in the print head 122 from being dried up and causing an obstruction, and to prevent a buildup of dust in the environment.

In the present embodiment, the cleaning and protecting device CP further includes a motor 160, a gear 170 and a control unit 180. The control unit 180 is electrically connected to the motor 160 and the cartridge 120 to perform corresponding controls to the both. The gear 170 is connected between the motor 160 and the rack 132 of the cap 130, and the scraper 140 is back facing the rack 132. This allows the motor 160, when driven by the control unit 180, to spur the gear 170 into a rotation and cause a motion effect of the cap 130 along a Z axis. For instance, when the control unit 180 drives the cartridge 120 to move out of the first segment S1 of the first path L1, and move into a first position P1 of the second segment S2 (as shown in FIG. 3), now, the cap 130 is located beneath the print head 122. The control unit 180 is then correspondingly driving the motor 160 to enable the motor 160 to move the cap 130 back and forth along the Z axis, or close to or away from the print head 122, so as to perform relative maintenance actions to the print head 122 located at the first position P1.

Figure 4:
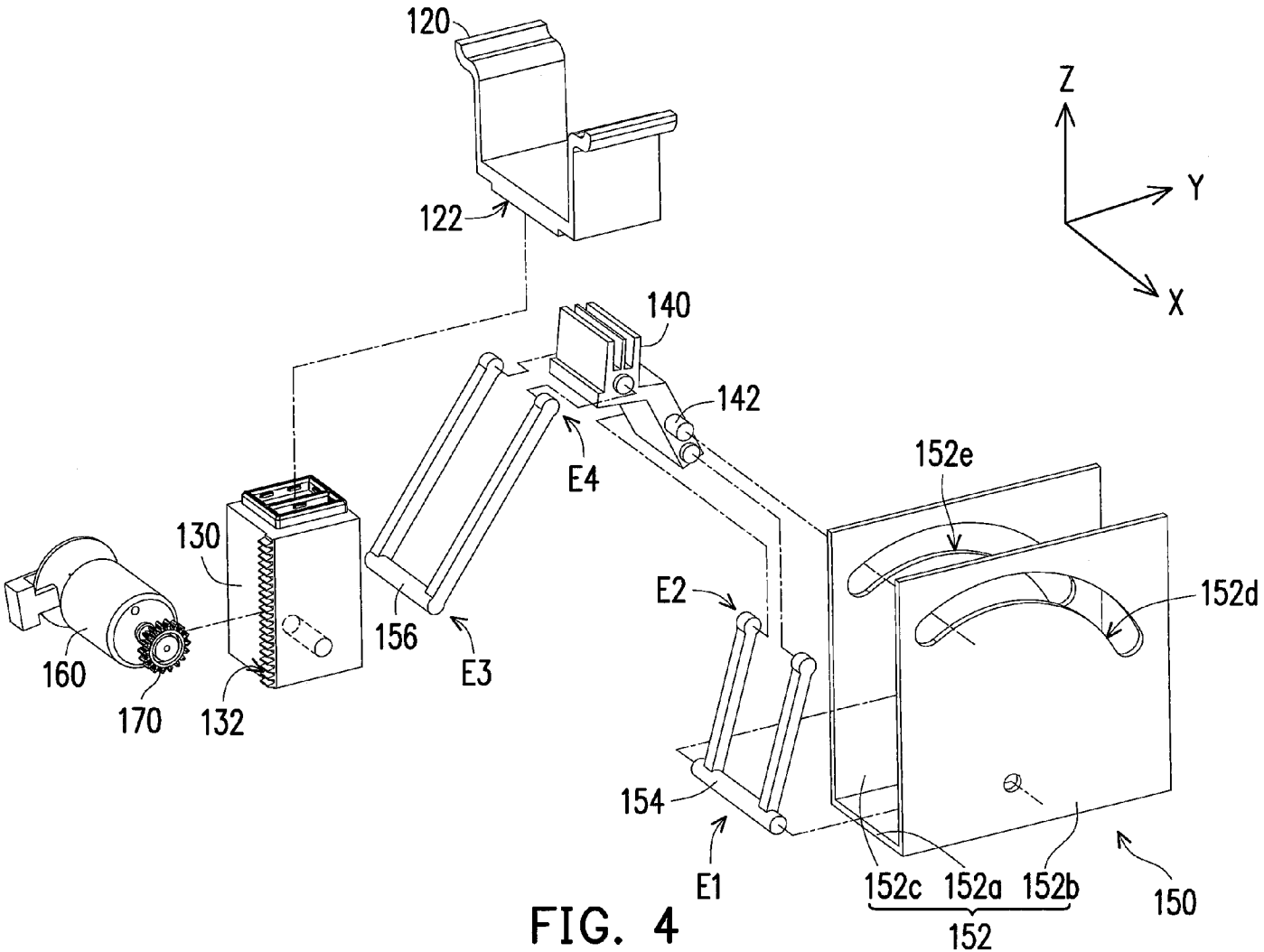
FIG. 4 is an exploded diagram illustrating a cleaning and protecting device of the office machine in FIG. 1.

FIG. 4 is an exploded diagram illustrating a cleaning and protecting device of the office machine in FIG. 1. Referring to FIG. 4, in detail, the transmission assembly 150 of the present embodiment includes a pedestal 152, a first connecting rod 154 and a second connecting rod 156. The pedestal 152 is constituted of a base plate 152*a* and a pair of side plates 152*b*, 152*c* extended from the base plate 152. In the present embodiment, the side plates 152*b*, 152*c* are perpendicular to the X axis and the base plate 152*a* is perpendicular to the Z axis, and the pair of side plates 152*b*, 152*c* has a pair of arcuate tracks 152*d*, 152*e* thereon. In other words, the pair of rails 152*d*, 152*e* is substantially parallel to the Y-Z plane.

Furthermore, the scraper 140 has a pair of slide rods 142 (herein, only one of the slide rods is being labeled due to the viewing angle) respectively coupled to the pair of arcuate tracks 152*d*, 152*e*, so that the scraper 140 can move in relative to the pedestal 152 via a coordination of the sliding rod 142 and the arcuate tracks 152*d*, 152*e*. Moreover, the first connecting rod 154 has a first end E1 and a second end E2 that are opposite to each other, wherein the first end E1 is pivotally connected to the side plates 152*b*, 152*c* of the pedestal 152, and the second end E2 is pivotally connected to the scraper 140. The second connecting rod 156 has a third end E3 and a fourth end E4 opposite to each other, wherein the third end E3 is pivotally connected to the cap 130, the fourth end E4 is pivotally connected to the scraper 140 and is located on the scraper 140, and the sliding rod 142 is located between the second end E2 and the fourth end E3.

Accordingly, the cap 130, the first connecting rod 154, the second connecting rod 156, the scraper 140 and the pedestal 152 (the arcuate tracks 152*d*, 152*e* thereof) are then formed a linkage mechanism. When the cap 130 moves back and forth on the second path L2 along the Z axis, the scraper 140 may be driven to move back and forth on the third path L3 in a geometrical plane A1 (a plane parallel to the Y-Z plane). Noteworthily, the first path L1, the second path L2 and the third path L3 form an intersection MP at an internal space within the body 110, wherein the first path L1 and the second path L2 are linear paths that perpendicular to each other, and the third path L3 is a curvilinear path. In other words, when the cartridge 120 moves to the first position P1, the transmission assembly 150 moves the scraper 140 via driving the cap 130, and thus, a corresponding relationship of linking action between the cap 130 and the scraper 140 is formed, thereby allowing the cartridge 120 and the cap 130, or the cartridge 120 and the scraper 140, to be intersected at the intersection MP under a specific condition, so as to perform a maintenance measure, such as scraping or covering, to the print head 122.

FIG. 5 through FIG. 8 are side view diagrams respectively illustrating relative components of FIG. 2 at different states. It is to be explained that when the cartridge 120 is still in the first segment S1 of the first path L1, the transmission assembly 150 maintains in a state illustrated in FIG. 2, namely, the cap 130 and the scraper 140, at this moment, are both not at the intersection MP, so as to avoid an interference and a collision of the components from occurring when the cartridge 120 moves into the second segment S2 of the first path L1.

Figure 5:
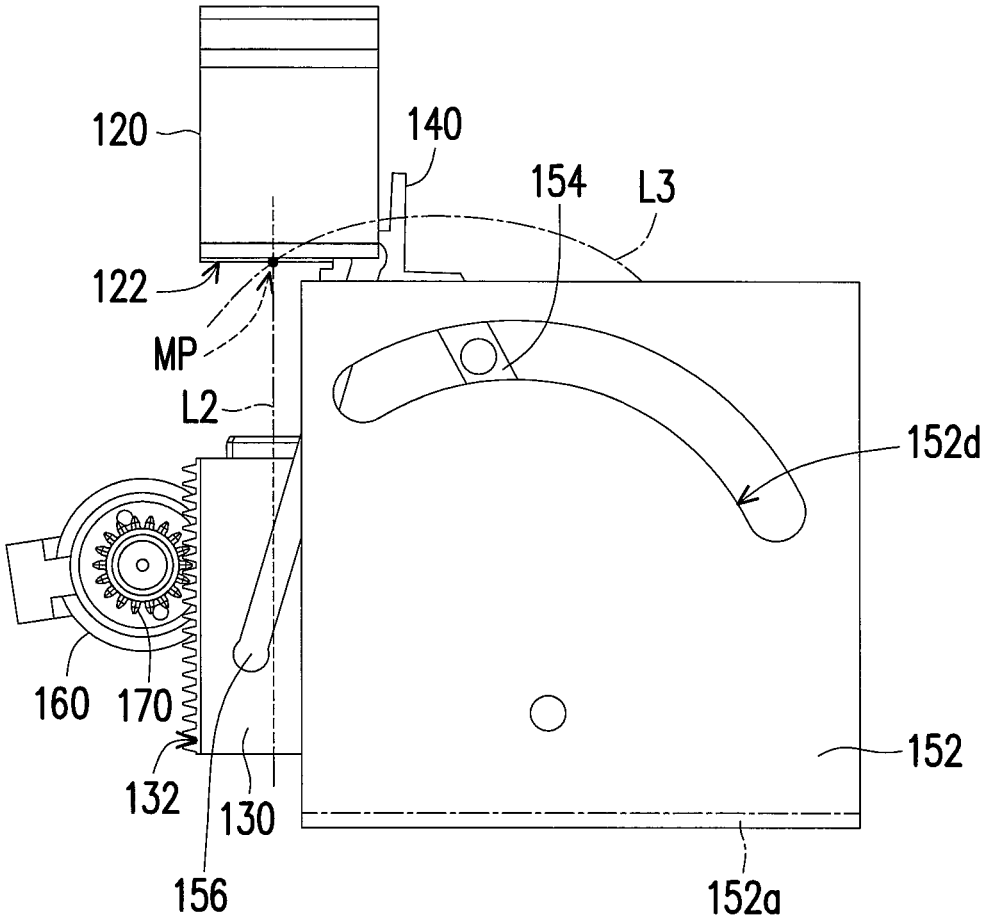
FIG. 5 through FIG. 8 are side view diagrams respectively illustrating relative components of FIG. 2 at different states.
Figure 6:
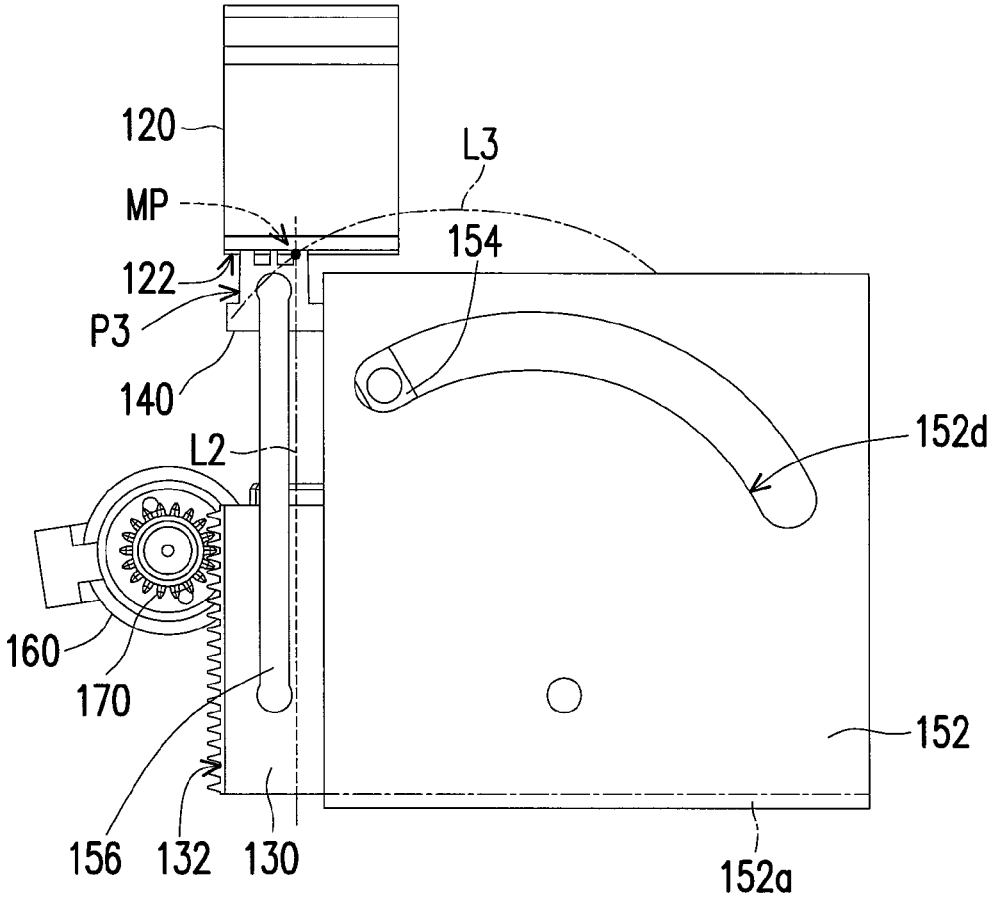
Figure 7:
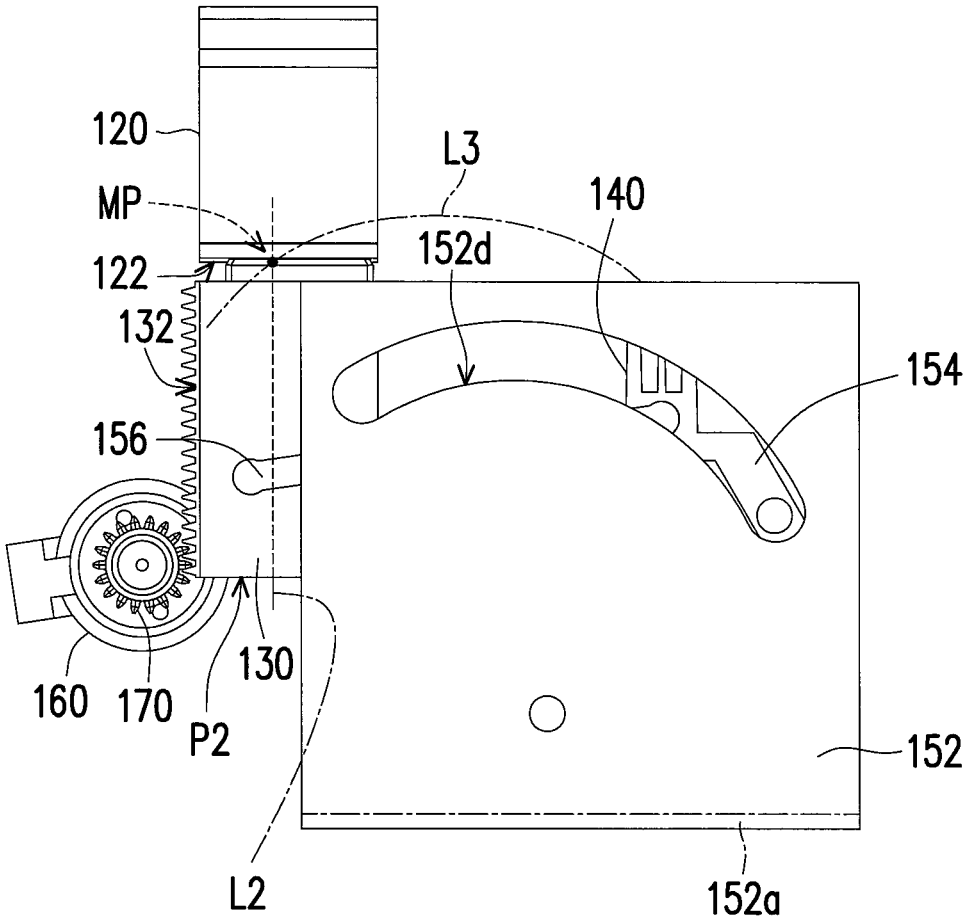

Next, when the cartridge 120 no longer performs the printing action and moves into the second segment S2 of the first path L1 (viz. the cartridge 120 moves to the first position P1, as shown in FIG. 1), then the control unit 180 drives the motor 160 to move the cap 130 away from the cartridge 120, namely, following a change of positions illustrated in FIG. 5 and FIG. 6, so that the cap 130 leans against the base plate 152*a* of the pedestal 152. As shown in FIG. 5 and FIG. 6, now, under the coordination of the first connecting rod 154, the second connecting rod 156 and the arcuate tracks 152*d*, 152*e* (only 152*d* is marked in FIG. 5 through FIG. 8), the scraper 140 moves to the third position P3 via the third path L3, and abuts the print head 122. Now, the scraper 140 is located beneath the print head 122, and the cap 130 is located beneath the scraper 140. As such, the first path L1 and the third path L3 form the intersection MP, thereby achieving the effect of using the scraper 140 to scrape the residual ink on the print head 122.

Next, referring to FIG. 5 through FIG. 8, after completed the action of scraping the residual ink, the control unit 180 (illustrate in FIG. 1 through FIG. 3) drives the motor 160 again so as to move the cap 130 towards the cartridge 120; and now, the scraper 140, driven by the transmission assembly 150, moves away from the cartridge 120 and the cap 130. Finally, the cap 130 leans against to the cartridge 120 and achieves the effect of covering the print head 122. As such, the maintenance action performing by the cleaning and protecting device CP to the print head 122, after the cartridge 120 moved into the second segments S2, is completed.

Figure 8:
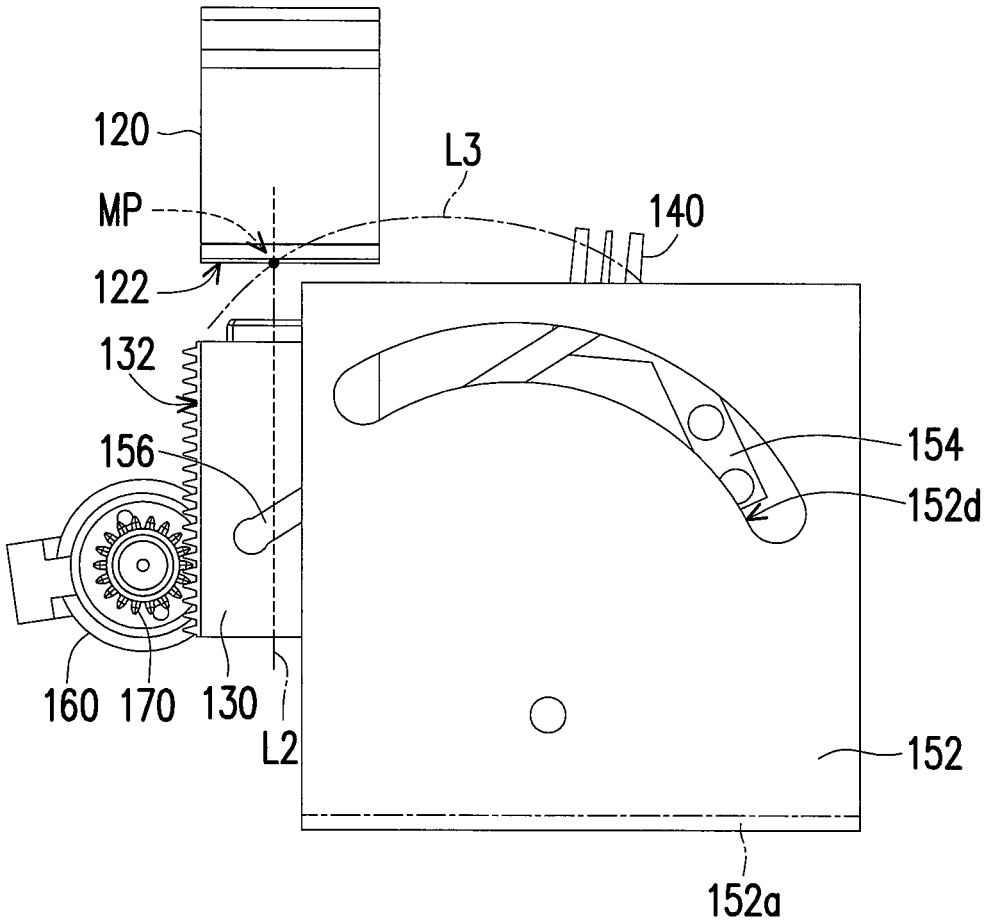

Contrarily, when it is to drive the cartridge 120 to perform printing again, the control unit 180 firstly drives the motor 160 to enable the motor 160 to move the cap 130 away from the cartridge 120 to show a state of opening the print head 122, namely, to enable the cap 130 to move away from the second position P2 (as shown in FIG. 8) and convert into the state illustrate in FIG. 2. Now, the control unit 180 drives the cartridge 120 to move away from the first position P1 and into the first segment S1 of the first path L1, so as to facilitate in the performance of the relative printing actions.

Figure 9:
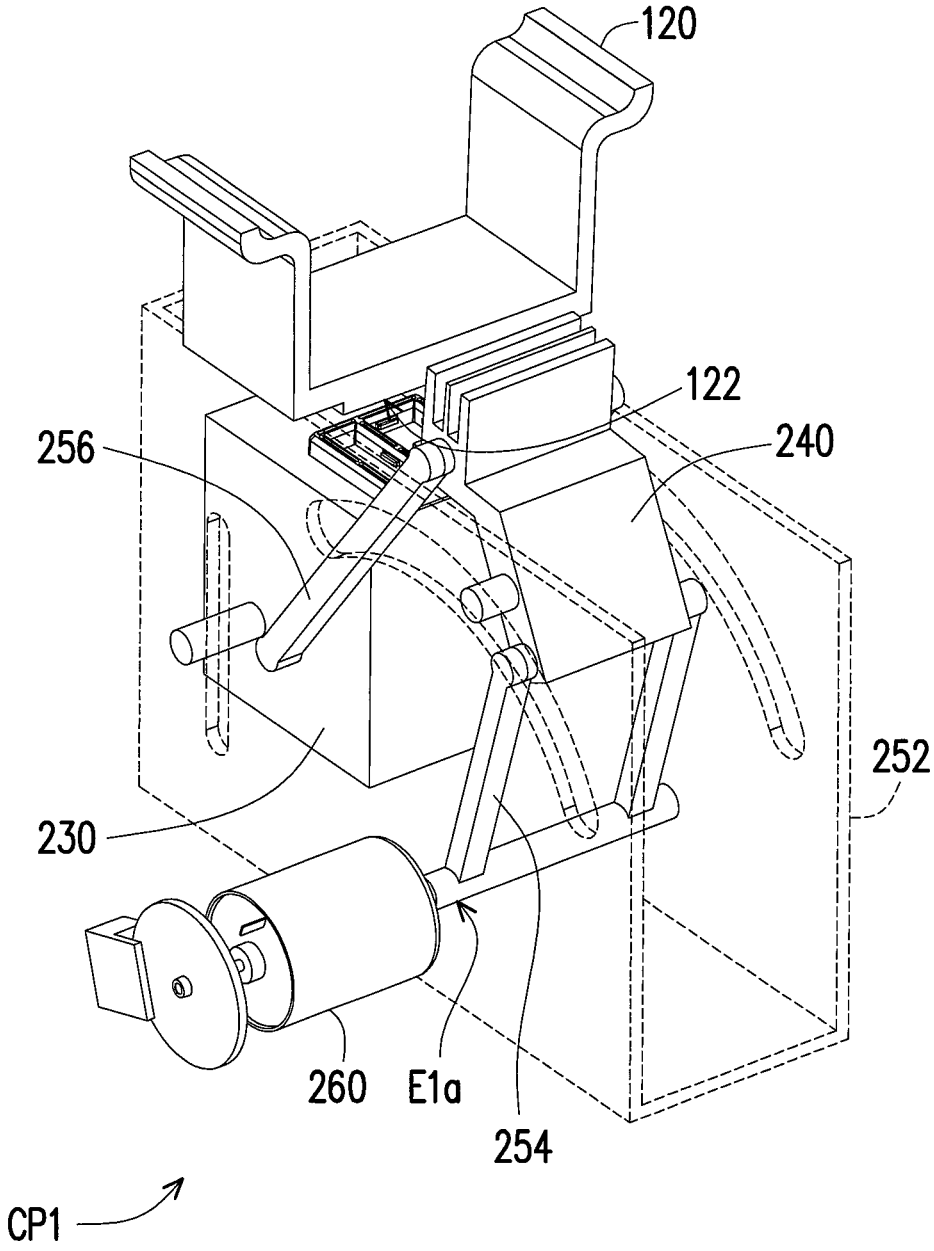
FIG. 9 is a partial component schematic diagram illustrating an office machine according to another embodiment of the invention.
Figure 10:
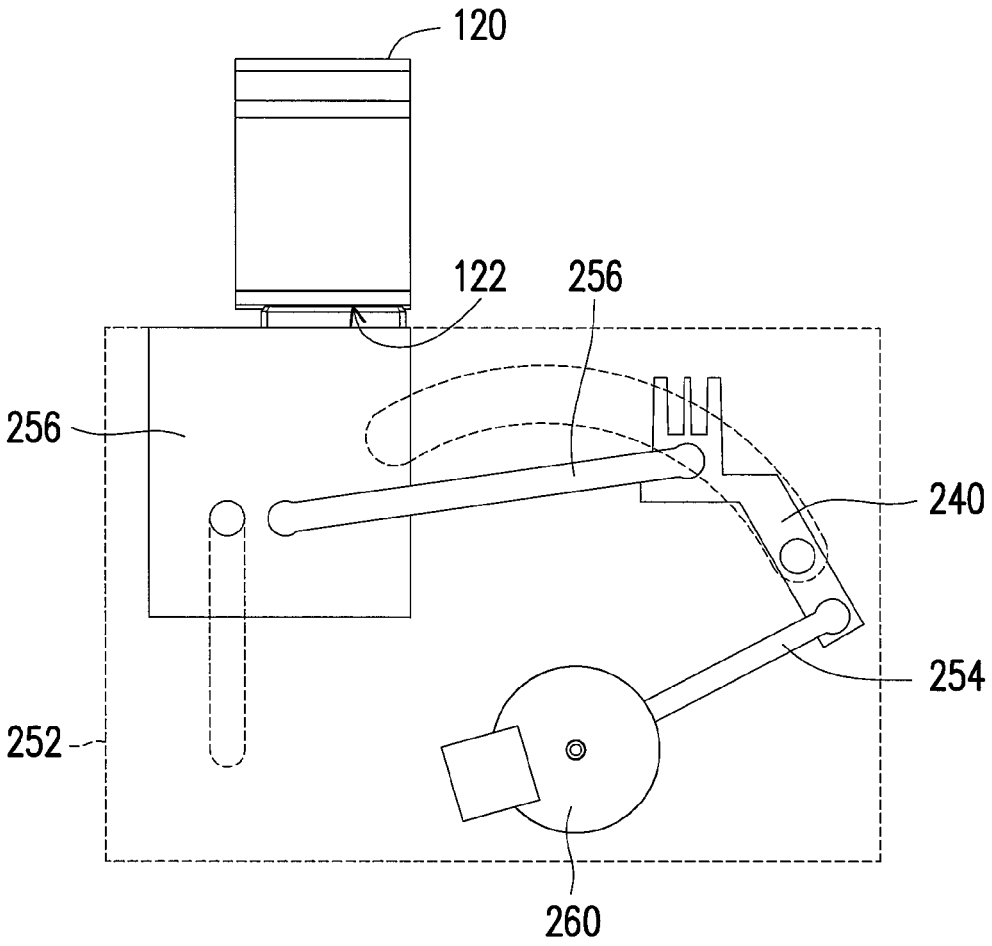
FIG. 10 and FIG. 11 respectively illustrate different states of a cleaning and protecting device in FIG. 8.
Figure 11:
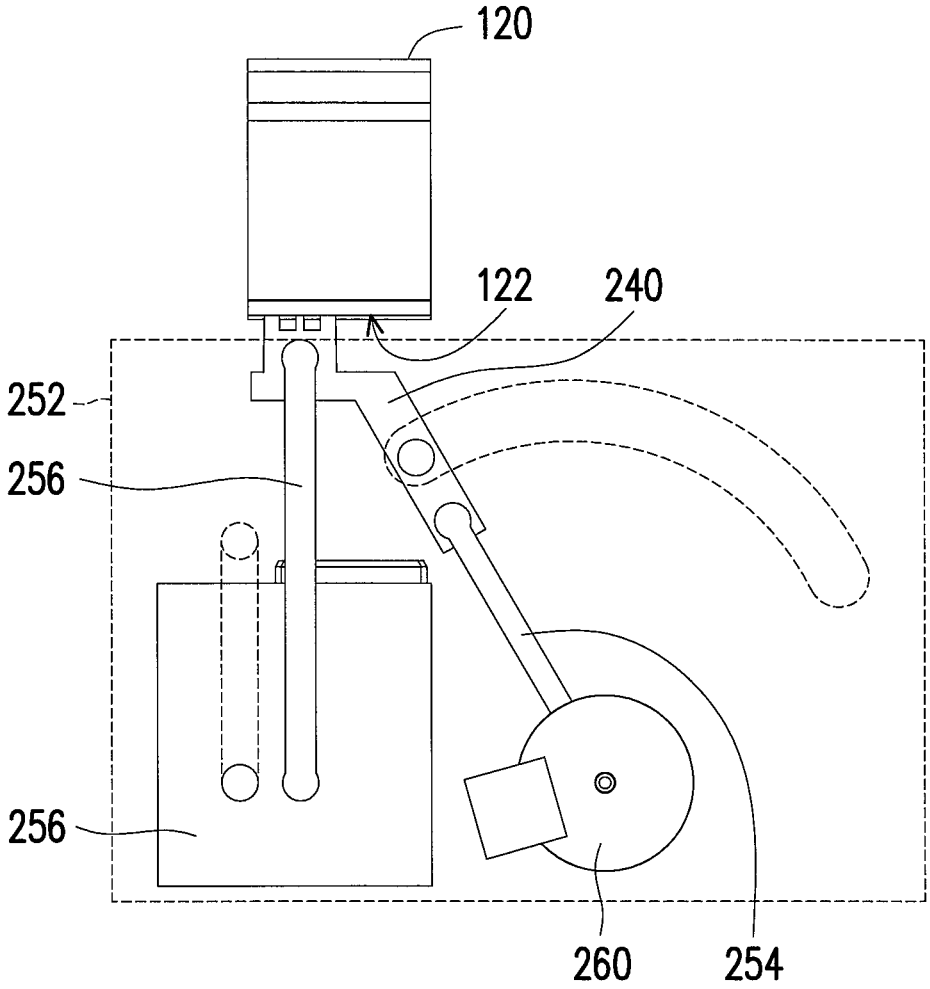

FIG. 9 is a partial component schematic diagram illustrating an office machine according to another embodiment of the invention. FIG. 10 and FIG. 11 respectively illustrate different states of a cleaning and protecting device in FIG. 8. Referring to FIG. 9 through FIG. 11 at the same time, in order to clearly represent the corresponding relationships between the components, a pedestal 252 is illustrated in a dashed line herein.

Different from the previous embodiment, in the cleaning and protecting device CP1 of the present embodiment, a motor 260 is directly connected to a first end E1*a* of a first connecting rod 254, and therefore, the motor 260 can directly drive the first connecting rod 254 to rotate in relative to the pedestal 252.

As a result, through the first connecting rod 254, a scraper 240, a second connecting rod 256 and a cap 230, a linkage mechanism is formed to enable the scraper 240 and the cap 230 to generate a relative movement so as to achieve effects of cleaning the print head 122 via the scraper 240 and covering the print head 122 via the cap 230, wherein the relative movement of the scraper 240 and the cap 230 is already described in the previous embodiment, and thus, is not repeated herein.

In other words, no matter in the previous embodiment or in the linkage mechanism formed by the first connecting rod 254, the scraper 240, the second connecting rod 256 and the cap 230 of the present embodiment, the invention in not intended to limit on which component is to be driven by a power source, and the motor 260, as being the power source, may be connected to any one of the components of the linkage mechanism via any possible means, so as to achieve an effect of bringing the linkage mechanism into motion.

In summary, in the aforementioned embodiments of the invention, the cleaning and protecting device and the office machine applying the same, via the transmission assembly disposed between the cap and the scraper, enable the cap and the scraper to respectively perform the maintenance actions (scraping the residual ink and providing the cover) to the cartridge that reaches the destined position through different paths. In other words, the invention, via the transmission assembly, enables the second path of the cap, and the third path of the scraper, to only form an intersection with the first path of the cartridge, respectively. In addition, the second path and the third path respectively maintain a corresponding singularity to the cap and the scraper, namely, a same component only performs a back and forth movement through one path. Therefore, the process of the movement of the component can be simplified so as to enhance a control on the component; and thereby, the cleaning and protecting device and the office machine applying the same may have favorable credibility and reliability.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A cleaning and protecting device suited for a cartridge, the cartridge suited for moving back and forth along a first axis and having a print head, and the cleaning and protecting device comprising:

a cap moving back and forth along a second axis, when the cartridge moves to a first position and the cap moves to a second position, the cap leaning against the cartridge to cover the print head;

a scraper; and a transmission assembly coupled to the cap and the scraper, when the cartridge is located at the first position and the cap moves away from the second position, the cap driving the transmission assembly to move the scraper to a third position to scrape residual ink on the print head, wherein the scraper has a pair of slide rods, and the transmission assembly comprises:

a pedestal having a pair of rails parallel to a geometrical plane, the first axis perpendicular to the geometrical plane, the second axis located on the geometrical plane, the pair of slide rods respectively coupled to the pair of rails to move the scraper along the pair of rails;

a first connecting rod, a first end of the first connecting rod pivotally connected to the pedestal, a second end of the first connecting rod pivotally connected to the scraper; and a second connecting rod, a third end of the second connecting rod pivotally connected to the cap, a fourth end of the second connecting rod pivotally connected to the scraper, wherein the pair of slide rods is located between the second end and the fourth end.

2. The cleaning and protecting device as recited in claim 1, wherein the first axis is perpendicular to the second axis.

3. The cleaning and protecting device as recited in claim 1, wherein the cap has a rack back facing the scraper, and the cleaning and protecting device further comprises:

a motor;

a gear connected between the motor and the rack; and a control unit electrically connected to the motor and the cartridge, when the cartridge moves to the first position, the control unit driving the motor to enable the motor to drive the cap to move via the gear and the rack.

4. The cleaning and protecting device as recited in claim 1 further comprising:

a motor connected to the first end to drive the first connecting rod; and a control unit electrically connected to the motor and the cartridge, when the cartridge moves to the first position, the control unit driving the motor to enable the motor to drive the first connecting rod and move the scraper, the second connecting rod and the cap.

5. The cleaning and protecting device as recited in claim 1, wherein the cartridge moves on a first path along the first axis, the cap moves on a second path along the second axis, the scraper driven by the transmission assembly is moving on a third path, and the first path, the second path and the third path form an intersection.

6. The cleaning and protecting device as recited in claim 1, wherein when the cartridge is at the first position, the cap is located beneath the print head.

7. The cleaning and protecting device as recited in claim 1, wherein when the scraper is at the third position, the scraper is located beneath the print head, and the cap is located beneath the scraper.

8. An office machine comprising:

a cartridge moving back and forth along a first axis and having a print head;

a cap moving back and forth along a second axis, when the cartridge moves to a first position and the cap moves to a second position, the cap leaning against the cartridge to cover the print head;

a scraper; and a transmission assembly coupled to the cap and the scraper, when the cartridge is located at the first position and the cap moves away from the second position, the cap driving the transmission assembly to move the scraper to a third position to scrape residual ink on the print head, wherein the scraper has a pair of slide rods, and the transmission assembly comprises:

a pedestal having a pair of rail, the pair of rails parallel to a geometrical plane, the first axis perpendicular to the geometrical plane, the second axis located on the geometrical plane, the pair of slide rods respectively coupled to the pair of rails to move the scraper along the pair of rails;

a first connecting rod, a first end of the first connecting rod pivotally connected to the pedestal, a second end of the first connecting rod pivotally connected to the scraper; and a second connecting rod, a third end of the second connecting rod pivotally connected to the cap, a fourth end of the second connecting rod pivotally connected to the scraper, wherein the pair of slide rods is located between the second end and the fourth end.

9. The office machine as recited in claim 8, wherein the first axis is perpendicular to the second axis.

10. The office machine as recited in claim 8, wherein the cap has a rack back facing the scraper, and the cleaning and protecting device further comprises:

a motor;

a gear connected between the motor and the rack; and a control unit electrically connected to the motor and the cartridge, when the cartridge moves to the first position, the control unit driving the motor to enable the motor to drive the cap to move via the gear and the rack.

11. The office machine as recited in claim 8 further comprising:

a motor connected to the first end to drive the first connecting rod; and a control unit electrically connected to the motor and the cartridge, when the cartridge moves to the first position, the control unit driving the motor to enable the motor to drive the first connecting rod and move the scraper, the second connecting rod and the cap.

12. The office machine as recited in claim 8, wherein the cartridge move on a first path along the first axis, the cap moves on a second path along the second axis, the scraper driven by the transmission assembly is moving on a third path, and the first path, the second path and the third path form an intersection.

13. The office machine as recited in claim 8, wherein when the cartridge is located at a first position, the cap is located beneath the print head.

14. The office machine as recited in claim 8, wherein when the scraper is located at the third position, the scraper is located beneath the print head, and the cap is located beneath the scraper.

15. The office machine as recited in claim 8 further comprising:

a body having two opposite sides, the cartridge moving back and forth along the first axis between the two opposite sides, the cap, the scraper and the transmission assembly located at one of the two opposite sides of the body.

* * * * *